US008779878B2

(12) United States Patent
Oki

(10) Patent No.: US 8,779,878 B2
(45) Date of Patent: Jul. 15, 2014

(54) MAGNETIC COMPONENT AND METHOD FOR MANUFACTURING MAGNETIC COMPONENT

(75) Inventor: Juichi Oki, Miyagi (JP)

(73) Assignee: Sumida Corporation, Tokyo (JP)

( * ) Notice: Subject to any disclaimer, the term of this patent is extended or adjusted under 35 U.S.C. 154(b) by 0 days.

(21) Appl. No.: 13/602,911

(22) Filed: Sep. 4, 2012

(65) Prior Publication Data

US 2013/0113585 A1 May 9, 2013

(30) Foreign Application Priority Data

Nov. 8, 2011 (JP) ..... 2011-244950

(51) Int. Cl.
*H01F 3/00* (2006.01)

(52) U.S. Cl.
USPC ..... 335/297; 336/192

(58) Field of Classification Search
USPC ..... 335/297
See application file for complete search history.

(56) References Cited

U.S. PATENT DOCUMENTS

| | | | | |
|---|---|---|---|---|
| 4,301,368 | A * | 11/1981 | Riihimaki | 250/385.1 |
| 5,631,616 | A * | 5/1997 | Ohta et al. | 335/216 |
| 7,071,803 | B2 * | 7/2006 | Oki | 336/83 |
| 7,358,841 | B2 * | 4/2008 | Kamio | 336/83 |
| 7,623,014 | B2 * | 11/2009 | Hsieh et al. | 336/83 |
| 8,325,000 | B2 * | 12/2012 | Oki et al. | 336/192 |
| 8,442,647 | B2 * | 5/2013 | Strandberg et al. | 607/115 |
| 2005/0001705 | A1 * | 1/2005 | Watanabe | 336/83 |
| 2005/0264389 | A1 * | 12/2005 | Gallup et al. | 336/83 |
| 2007/0146110 | A1 * | 6/2007 | Oki | 336/232 |
| 2009/0179724 | A1 * | 7/2009 | Sano et al. | 336/221 |
| 2009/0315660 | A1 * | 12/2009 | Oki | 336/192 |
| 2011/0006867 | A1 * | 1/2011 | Oki et al. | 336/192 |
| 2011/0115592 | A1 * | 5/2011 | Kitajima et al. | 336/83 |

FOREIGN PATENT DOCUMENTS

| | | |
|---|---|---|
| JP | A-2008-172872 | 7/2008 |
| JP | A-2009-290093 | 12/2009 |

* cited by examiner

*Primary Examiner* — Shawki S Ismail
*Assistant Examiner* — Lisa Homza
(74) *Attorney, Agent, or Firm* — Oliff PLC

(57) ABSTRACT

A magnetic component includes: a magnetic core including an upper flange portion on one end side of a winding shaft portion and a lower flange portion on another end side of the winding shaft portion; a pair of conductive terminals attached to the lower flange portion; and a coil including a conductive wire. The terminals each include an electrode portion extending along a lower surface of the lower flange portion and including an end portion projecting outward relative to an outer periphery of the lower flange portion, and a columnar wire splicing portion erected from the end portion of the electrode portion, and an upper end surface of the wire splicing portion includes a wire splicing surface for conductive wire connection.

14 Claims, 5 Drawing Sheets

MAGNETIC COMPONENT AND METHOD FOR MANUFACTURING MAGNETIC COMPONENT

BACKGROUND OF THE INVENTION

1. Field of the Invention

The present invention relates to a magnetic component including a magnetic core that includes a flange portion at each of opposite end portions of a winding shaft portion around which a conductive wire is wound, and a conductive terminal that includes a wire splicing surface for conductive wire connection, and a method for manufacturing such magnetic component.

2. Description of the Related Art

Conventionally, magnetic components such as disclosed in Japanese Laid-Open Patent Publication No. 2009-290093(A) are known. An example of this type of magnetic component is illustrated in FIGS. 7 and 8, and a conventional magnetic component will be described below with reference to these drawings. The illustrated magnetic component 110 includes a magnetic core 120, conductive terminals 130A and 130B and a coil 140.

As illustrated in FIG. 8, the magnetic core 120 includes a winding shaft portion 121 for conductive wire winding, and an upper flange portion 123 and a lower flange portion 125 provided on one end side of the winding shaft portion 121 (upper end side in the Figure) and another end side (lower end side in the Figure), respectively.

The terminals 130A and 130B each include an electrode portion 131 extending along a lower surface of the lower flange portion 125, and a wire splicing portion 133 extending from an end portion of the electrode portion 131. The electrode portion 131 is attached to the lower flange portion 125 so as to be in contact with the lower surface of the lower flange portion 125. The wire splicing portion 133 includes a part extending upward in the Figure (direction toward the upper flange portion 123), which is flexed at an angle of 90 degrees from the end portion of the electrode portion 131 (hereinafter this part is referred to as "erected portion"), and a part extending laterally (direction perpendicular to an axis of the winding shaft portion 121), which is further flexed at an angle of 90 degrees from an upper end portion of the erected portion (hereinafter this part is referred to as "laterally-flexed portion"), and an upper surface of the laterally-flexed portion includes a wire splicing surface 135 for conductive wire connection. These terminals 130A and 130B are each formed by flexing a metal plate material via, e.g., press working.

The coil 140 includes a conductive wire 141 wound around the winding shaft portion 121. Respective end portions 141*a* and 141*b* of the conductive wire 141 are connected to the respective wire splicing surfaces 135 of the terminals 130A and 130B via, e.g., thermal compression bonding or resistance welding.

FIG. 9 illustrates a schematic configuration when connecting the respective end portions 141*a* and 141*b* of the conductive wire 141 of the above-described magnetic component 110 to the respective wire splicing surfaces 135 of the terminals 130A and 130B via thermal compression bonding. The illustrated welding jig 170 is a jig having a general configuration, which is used when connecting end portions of a conductive wire in a conventional magnetic component such as the magnetic component 110 to wire splicing surfaces of terminals via thermal compression bonding.

As illustrated in the Figure, the welding jig 170 includes projection portions 171A and 171B. These projection portions 171A and 171B are provided to support the respective wire splicing surfaces 135 of the terminals 130A and 130B (the above-described laterally-flexed portions) from the lower side, which are pressed from the upper side in the Figure by a welding electrode 180, when connecting the respective end portions 141*a* and 141*b* of the conductive wire 141 to the respective wire splicing surfaces 135 of the terminals 130A and 130B via thermal compression bonding.

In order to connect the respective end portions 141*a* and 141*b* of the conductive wire 141 to the respective wire splicing surfaces 135 of the terminals 130A and 130B of the above-described conventional magnetic component 110 with good precision via thermal compression bonding, it is necessary that welding electrode 180 sufficiently press the respective wire splicing surfaces 135 of the terminals 130A and 130B while crushing the respective end portions 141*a* and 141*b* of the conductive wire 141 to a predetermined extent. In particular, where the magnetic component 110 is downsized so as to have external dimensions of around several millimeters, each wire splicing surface 135 is inevitably downsized, resulting in reduction in the area of the part to be welded, and thus, provision of a proper extent of crushing of the respective end portions 141*a* and 141*b* of the conductive wire 141 during thermal compression bonding is important for favorable connection of the conductive wire 141.

However, since the terminals 130A and 130B of the conventional magnetic component 110 are each formed by flexing a metal plate via, e.g., press working, large variations easily occur in a dimension in the height direction of the wire splicing portions 133. This is because not only errors caused by processing using, e.g., a pressing machine but also a tolerance in thickness of the metal plate affect the dimension in the height direction of the wire splicing portions 133.

Where large variations occur in the dimension in the height of the wire splicing portions 133, a fixed distance between a lower surface of the welding electrode 180 and each wire splicing surface 135 during thermal compression bonding cannot be maintained, making is difficult to provide a proper extent of crushing of the respective end portions 141*a* and 141*b* of the conductive wire 141, which may cause various types of failures. For example, if the extent of crushing is reduced, it may be impossible to provide sufficient connection strength, and conversely, if the extent of crushing is overly increased, the conductive wire 140 may be disconnected.

Also, a problem lies also in errors in dimension in the height direction of the projection portions 171A and 171B included in the welding jig 170. In other words, if the height of the projection portions 171A and 171B is smaller than a prescribed value, a distance $\epsilon$ between lower surfaces of the laterally-flexed portions of the terminals 130A and 130B and upper surfaces of the projection portions 171A and 171B is large. If the distances is excessively large, the laterally-flexed portions of the terminals 130A and 130B are pressed by the welding electrode 180 and thereby bent downward during thermal compression bonding, whereby the extent of crushing of the respective end portions 141*a* and 141*b* of the conductive wire 141 becomes small, which may result in impossibility to provide sufficient connection strength. Conversely, if the height of the projection portions 171A and 171B is larger than the prescribed value, a position in height direction of the wire splicing surfaces 135 is raised, whereby the extent of crushing of the respective end portions 141*a* and 141*b* of the conductive wire 141 during thermal compression bonding becomes too large, which may cause disconnection of the conductive wire 140.

SUMMARY OF THE INVENTION

The present invention has been made in view of the aforementioned circumstances, and an object of the present invention is to provide a magnetic component enabling an end portion of a conductive wire wound around a winding shaft portion of a magnetic core to be stably and favorably connected to a wire splicing surface of a terminal, and a method for manufacturing such magnetic component.

In order to achieve the above object, a magnetic component according to the present invention has the following characteristics.

In other words, a magnetic component according to the present invention includes: a magnetic core including an upper flange portion on one end side of a winding shaft portion and a lower flange portion on another end side of the winding shaft portion; a conductive terminal attached to the lower flange portion; and a conductive wire wound around the winding shaft portion, wherein the terminal includes an electrode portion extending along a lower surface of the lower flange portion and including an end portion projecting outward relative to an outer periphery of the lower flange portion, and a columnar wire splicing portion erected from the end portion of the electrode portion; and wherein an upper end surface of the wire splicing portion includes a wire splicing surface for conductive wire connection, and an end portion of the conductive wire is connected to the wire splicing surface.

In the magnetic component according to the present invention, the conductive wire can be a coated conductive wire including a core wire and an insulating coating covering the core wire.

Also, it is preferable that the magnetic core be a ferrite core including an Ni—Zn ferrite or an Mn—Zn ferrite.

The terminal according to the present invention may include an electrode portion extending along an outer end surface of one of the flange portions and including an end portion projecting outward relative to an outer periphery of the one of the flange portions, and a triangular columnar wire splicing portion erected from the end portion of the electrode portion.

Further, it is preferable that the wire splicing surface, which is an upper end surface of the erected part of the wire splicing portion, is arranged perpendicular to a side surface of the erected part.

In the magnetic component according to the present invention, a height H of the wire splicing portion may be larger than a length T−R obtained by subtracting a length R corresponding to a radius of the conductive wire wound around the winding shaft portion from a thickness T of the one of the flange portions.

Further, the height H of the wire splicing portion may be smaller than a length T+W−D obtained by subtracting a length D corresponding to a diameter of the conductive wire wound around the winding shaft portion from a value obtained by adding a width W of the winding shaft portion to the thickness T.

Still further, the height H of the wire splicing portion may be smaller than a length T+D obtained by adding a length D corresponding to a diameter of the conductive wire wound around the winding shaft portion to the thickness T.

In the magnetic component according to the present invention, the conductive wire may have a diameter of 0.02 to 0.30 mm.

Further, the conductive wire may have a diameter of 0.02 to 0.10 mm.

In the magnetic component according to the present invention, a round surface is provided in a boundary part between a side surface of the wire splicing portion and the wire splicing surface.

The boundary part between a side surface of the wire splicing portion and the wire splicing surface may be a chamfered surface.

It is preferable that a side surface of the wire splicing portion of the terminal includes a curved surface.

Also, a method for manufacturing a magnetic component according to the present invention includes connecting the end portion of the conductive wire of the aforementioned magnetic component according to the present invention to the wire splicing surface via thermal compression bonding or resistance welding.

The "columnar" in the "columnar wire splicing portion" in the above basically refers to a shape in which a gauge (cross-sectional area) of a wire splicing portion is constant over the entire length in the height direction of the wire splicing portion, but is not intended to exclude a shape in which the gauge of the wire splicing portion varies.

DESCRIPTION OF THE PREFERRED EMBODIMENTS

A magnetic component and a method for manufacturing a magnetic component according to an embodiment of the present invention will be described in detail below with reference to the drawings.

<Configuration of Magnetic Component>

Figure 1:
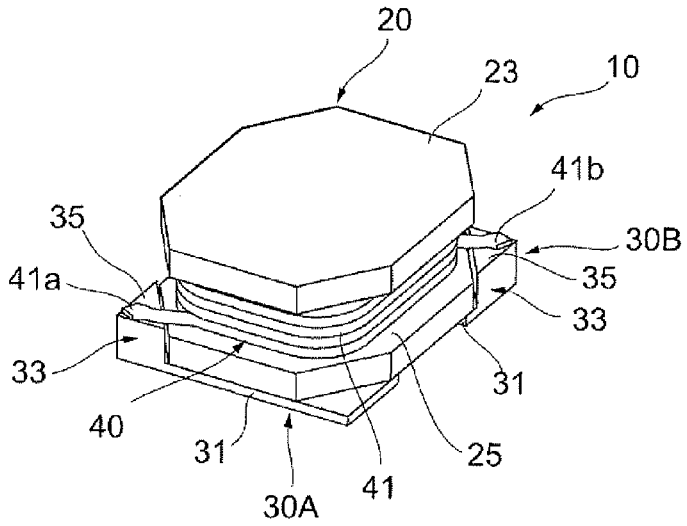
FIG. 1 is a perspective diagram illustrating an overall configuration of a magnetic component according to an embodiment of the present invention.
Figure 2:
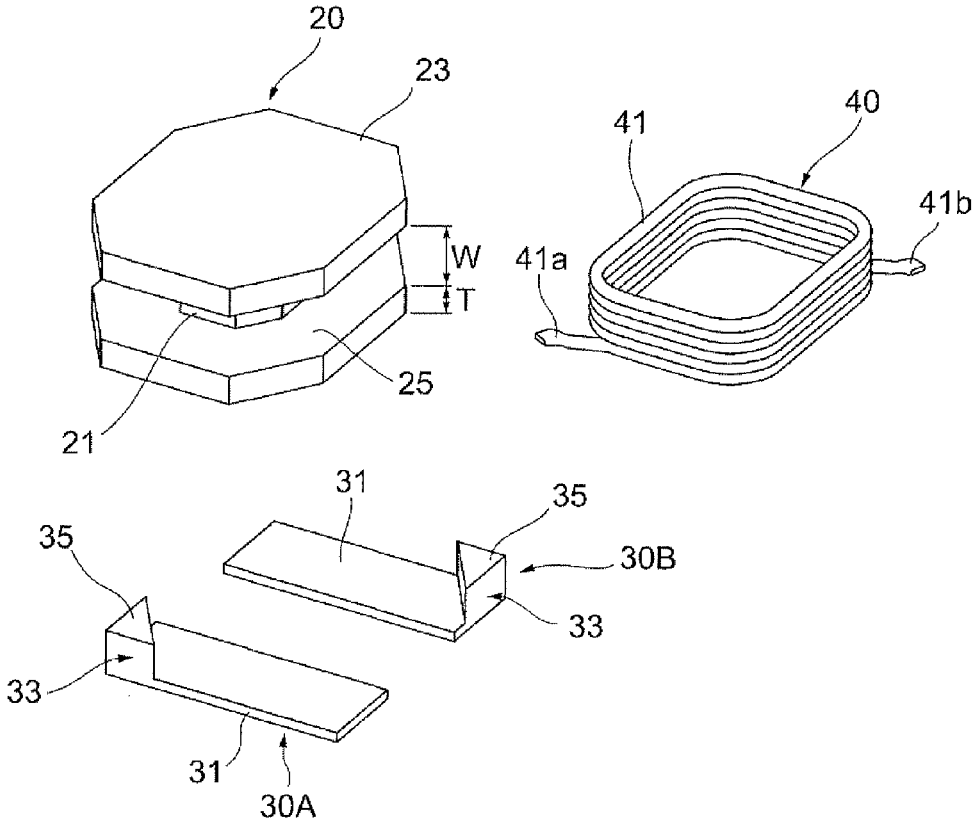
FIG. 2 is an exploded perspective view of the magnetic component illustrated in FIG. 1.

As illustrated in FIGS. 1 and 2, a magnetic component 10 according to an embodiment of the present invention includes: a magnetic core 20 including an upper flange portion 23 on one end side (upper end side in the Figure) of a winding shaft portion 21 and a lower flange portion 25 on another end side (lower end side in the Figure) of the winding shaft portion 21; a pair of conductive terminals 30A and 30B attached to the lower flange portion 25; and a coil 40 including a conductive wire 41.

The upper flange portion 23 and the lower flange portion 25 of the magnetic core 20 each have a same size and a same shape (octagonal shape), and the winding shaft portion 21 has an octagonal columnar shape. Also, the magnetic core 20 includes a ferrite core including a Ni—Zn ferrite or an Mn—Zn ferrite. Formation of the magnetic core 20 using an Ni—Zn ferrite or an Mn—Zn ferrite as described above enables the magnetic core 20 to be downsized compared to a case where the magnetic core 20 includes an Fe—Si alloy or an Fe—Ni alloy.

The terminals 30A and 30B each include an electrode portion 31 extending along a lower surface of the lower flange portion 25 and including an end portion projecting outward relative to an outer periphery of the lower flange portion 25, and a triangular columnar wire splicing portion 33 erected from the end portion of the electrode portion 31, and an upper end surface of the wire splicing portion 33 includes a wire splicing surface 35 for conductive wire connection. In other words, respective end portions 41*a* and 41*b* of the conductive wire 41 wound around the winding shaft portion 21 of the magnetic core 20 is connected to the wire splicing surface 35 via thermal compression bonding or resistance welding.

Figure 3A:
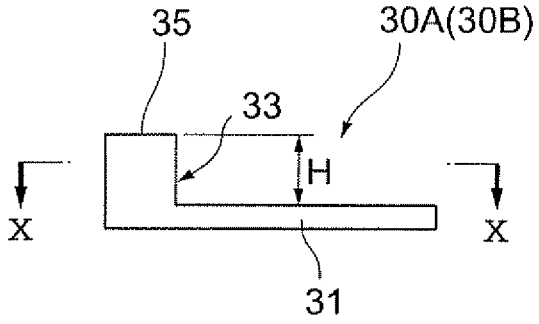
FIG. 3A is a side view of a terminal illustrated in FIG. 1.
Figure 8:
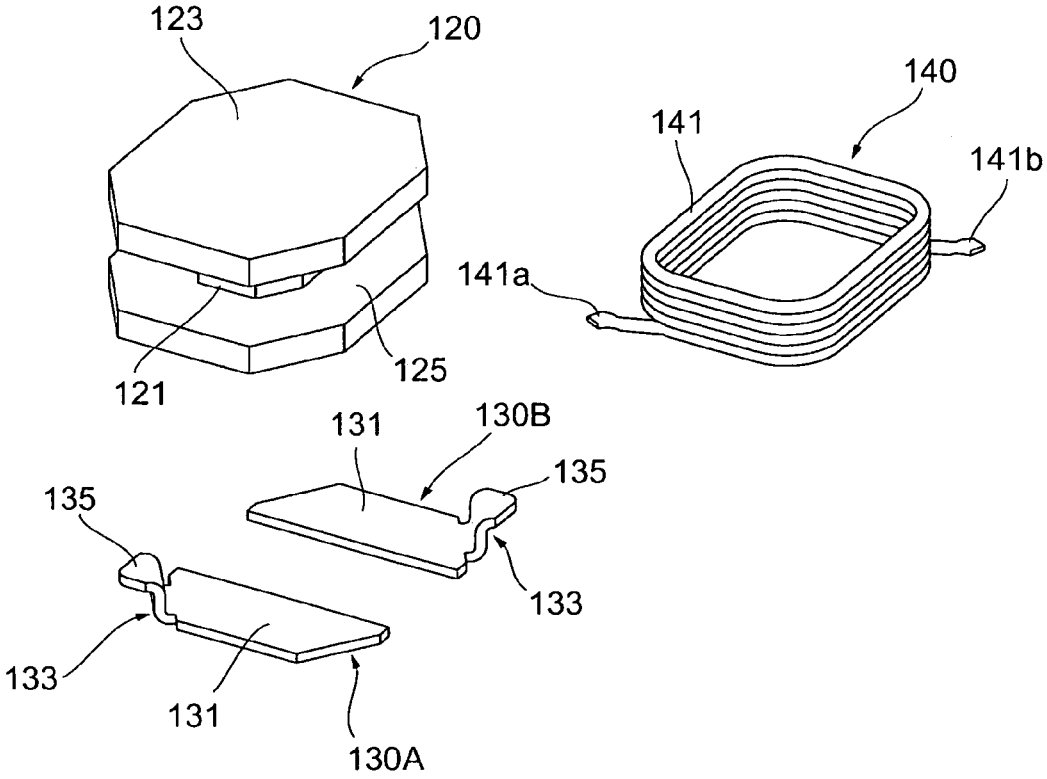
FIG. 8 Prior Art
FIG. 8 is an exploded perspective view of the conventional magnetic component illustrated in FIG. 7.

Furthermore, in the magnetic component 10 according to the present embodiment, as illustrated in FIG. 3A, the respective wire splicing surfaces 35 of the terminals 30A and 3013 are arranged perpendicular to respective side surfaces of the wire splicing portions 33. Arrangement of the wire splicing surfaces 35 perpendicular to the side surfaces of the wire splicing portions 33 as described above enables the areas of the wire splicing surfaces 35 to be large. Meanwhile, where a wire splicing portion 133 (see FIG. 8) is formed by flexing a metal plate as in the conventional technique, a curved surface portion (round portion) according to the thickness of the metal plate is formed at a boundary part between an erected portion and a laterally-flexed portion of the wire splicing portion 133, resulting in the area of the wire splicing surface 135 (see FIG. 8) being reduced by that amount. Alternatively, if the area of a conventional wire splicing surface 135 is made to be equal to that of the wire splicing surface 35 according to the present embodiment, the wire splicing surface 135 further extends outside of the magnetic core 120 by the amount of the curved surface portion (round portion), resulting in difficulty in downsizing of the magnetic component 110.

Figure 3B:
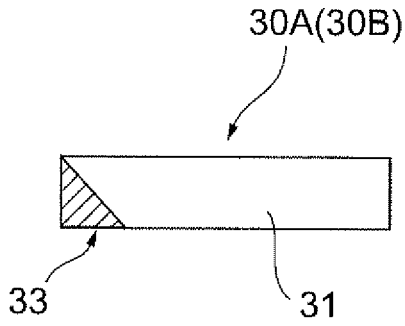
FIG. 3B is a cross-sectional view along line X-X in FIG. 1.

Furthermore, a gauge (cross-sectional area in a horizontal direction) of the wire splicing portion 33 is formed to be constant in the height direction of the wire splicing portion 33, and as illustrated in FIG. 3B, a cross-sectional shape in the horizontal direction of the wire splicing portion 33 is a right triangle (which is the same as a shape of the wire splicing surface 35). When, e.g., thermal compression bonding is performed, a predetermined force (force received from a welding electrode) is imposed on the wire splicing portion 33 in an axial direction of the wire splicing portion 33. The wire splicing portion 33 is configured so as to bear such force, neither being plastically deformed nor buckled even if such force is imposed on the wire splicing portion 33. For example, slenderness ratio (column length/radius of gyration) is known as an index indicating a resistance of a columnar body to be buckled, and a slenderness ratio of the wire splicing portion 33 is set to one that prevents the wire splicing portion from being buckled even if a force is imposed on the wire splicing portion 33 in the axial direction during, e.g., thermal compression bonding.

Furthermore, a dimension H in the height direction (height from an upper surface of the electrode portion 31) (see FIG. 3A) of the wire splicing portion 33 is set to be larger than a dimension obtained by subtracting a length corresponding to a radius of the conductive wire 41 wound around the winding shaft portion 21 of the magnetic core 20 from a dimension T (see FIG. 2) in the height direction (thickness) of the lower flange portion 25.

More specifically, the dimension H in the height direction of the wire splicing portion 33 is set to be larger than the dimension obtained by subtracting the length corresponding to the radius of the conductive wire 41 of the magnetic core 20 wound around the winding shaft portion 21 from the dimension T in the height direction of the lower flange portion 25, and also to be smaller than a dimension obtained by subtracting a length corresponding to a diameter of the conductive wire 41 wound around the winding shaft portion 21 of the magnetic core 20 from a dimension obtained by adding a dimension (width) W (see FIG. 2) in the height direction of the winding shaft portion 21 of the magnetic core 20 to the dimension T.

In particular, it is preferable that the dimension H in the height direction of the wire splicing portion 33 be set to be larger than the dimension obtained by subtracting the length corresponding to the radius of the conductive wire 41 wound around the winding shaft portion 21 of the magnetic core 20 from the dimension T in the height direction of the lower flange portion 25, and also to be smaller than a dimension obtained by adding the length corresponding to the diameter of the conductive wire 41 wound around the winding shaft portion 21 of the magnetic core 20 to the dimension T.

As a result of determining the dimension H in the height direction of the wire splicing portion 33 as described above, the possibility of disconnection of the conductive wire 41 when connecting the respective end portions of the conductive wire 41 wound around the winding shaft portion 21 of the magnetic core 20 to the wire splicing surface 35 via, e.g., thermal compression bonding can be lowered.

The coil 40 includes the conductive wire 41 wound around the winding shaft portion 21 of the magnetic core 20. The conductive wire 41 includes a coated conductive wire including a core wire (not illustrated) and an insulating coating covering the core wire (not illustrated), and the respective end portions 41*a* and 41*b* of the conductive wire 41 are connected to the wire splicing surfaces 35 of the terminals 30A and 30B via, e.g., thermal compression bonding or resistance welding.

For the conductive wire 41, for example, one having an arbitrary gauge from among conductive wires having a diameter ranging from 0.02 to 0.30 mm can be used according to the size of the magnetic component 10. For example, an ultrafine wire having a diameter of around 0.02 to 0.05 mm or a fine wire having a diameter of around 0.05 to 0.10 mm can be used. Also, a wire having a diameter that is or exceeds around 0.10 to 0.20 mm can be used.

<Method for Manufacturing Magnetic Component>

Figure 4:
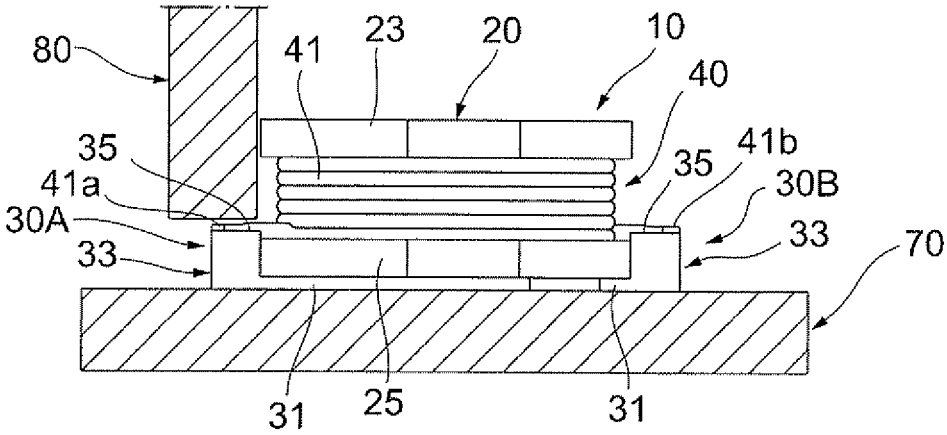
FIG. 4 is a schematic diagram illustrating a method for manufacturing a magnetic component according to an embodiment of the present invention.

As illustrated in FIG. 4, a method for manufacturing a magnetic component according to an embodiment of the present invention, which includes connecting the respective end portions 41*a* and 41*b* of the conductive wire 41 of the above-described magnetic component 10 to the wire splicing surfaces 35 of the terminals 30A and 30B via thermal compression bonding, is performed in the following procedure.

Figure 9:
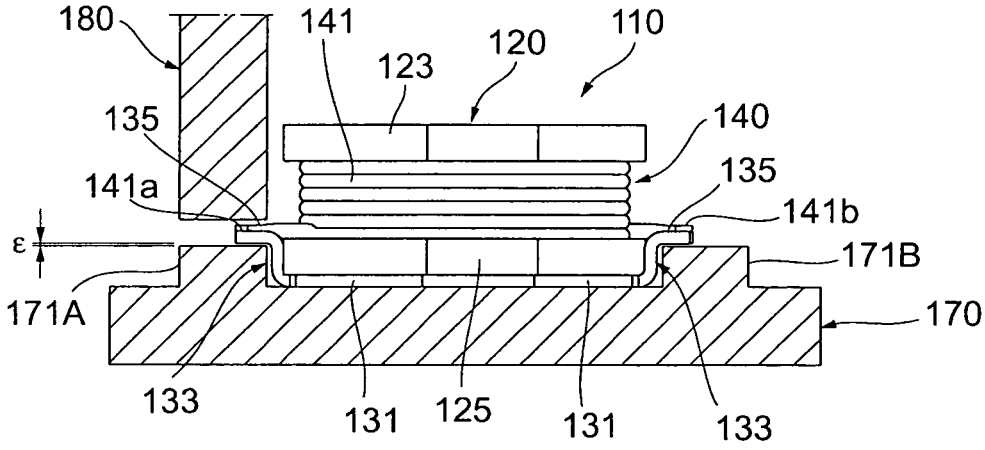
FIG. 9 Prior Art
FIG. 9 is a schematic diagram when connecting end portions of a conductive wire of a conventional magnetic component to wire splicing surfaces of terminals via thermal compression bonding.

(1) The conductive wire 41 is wound around the winding shaft portion 21 of the magnetic core 20 and the magnetic component 10 with the respective end portions 41*a* and 41*b* of the conductive wire 41 mounted on the wire splicing surfaces 35 of the terminals 30A and 30B is set on a welding jig 70. Since the wire splicing portions 33 of the terminals 30A and 30B each have a columnar shape, the welding jig 70 has a planar shape so as to wholly support the terminals 30A and 30B, and has no projection portions 171A and 171B (see FIG. 9) provided in the conventional welding jig 170 (see FIG. 9).

(2) A distance of movement of the welding electrode 80 in the vertical direction in the Figure is adjusted. The adjustment of the distance of movement is made so that an extent of crushing of the end portions 41*a* and 41*b* becomes proper when the respective end portions 41*a* and 41*b* of the conductive wire 41 on the wire splicing surfaces 35 are pressed by the welding electrode 80, in consideration of the position in the height direction of the wire splicing surfaces 35 of the terminals 30A and 3013 (which is calculated based on a designed dimension in the height direction of the wire splicing portions 33) and the diameter of the conductive wire 41.

(3) The welding electrode 80 is lowered, and the respective end portions 41*a* and 41*b* of the conductive wire 41 on the wire splicing surfaces 35 are pressed and crushed by a lower surface of the welding electrode 80 to weld the respective end portions 41*a* and 41*b* to the wire splicing surfaces 35.

The position in the height direction of the wire splicing surfaces 35 of the magnetic component 10 has only a small variation from a designed value because the wire splicing portions 33 have a columnar shape. Thus, a proper extent of crushing of respective end portions 41*a* and 41*b* of a conductive wire 41 during thermal compression bonding can be provided to each of magnetic components 10 having same design specifications, enabling the respective end portions 41*a* and 41*b* of the conductive wire 41 to be connected to wire splicing surfaces 35 stably and favorably.

<Modification of Terminals>

Figure 5A:
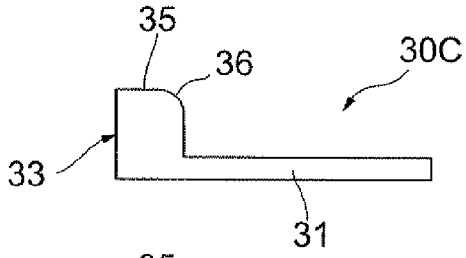
FIGS. 5A to 5C are each a side view of a terminal, which each illustrate a variation of a wire splicing surface.
Figure 5B:
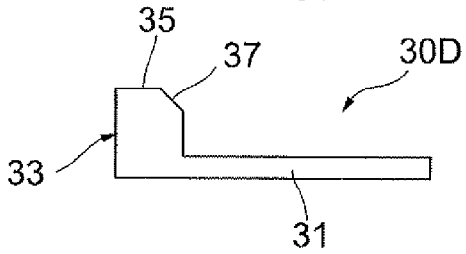
Figure 5C:
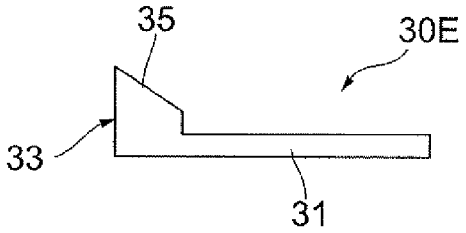
Figure 6A:
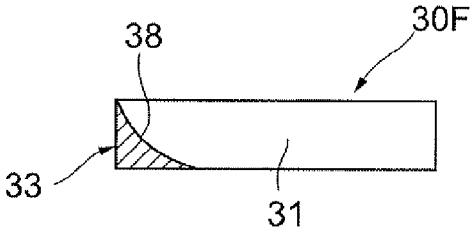
FIGS. 6A to 6C are each a cross-sectional view of a terminal, which each illustrates a variation of a cross-sectional shape of a wire splicing portion.
Figure 6B:
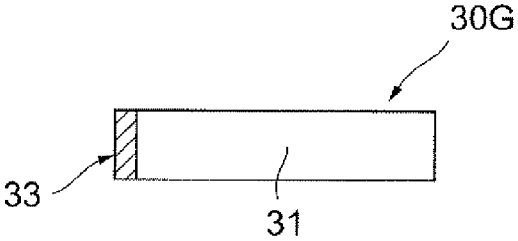
Figure 6C:
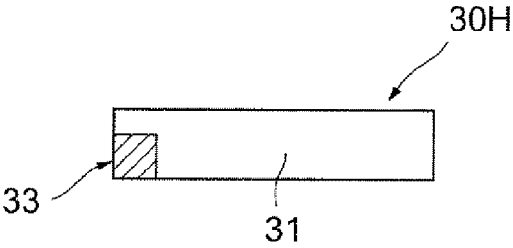
Figure 7:
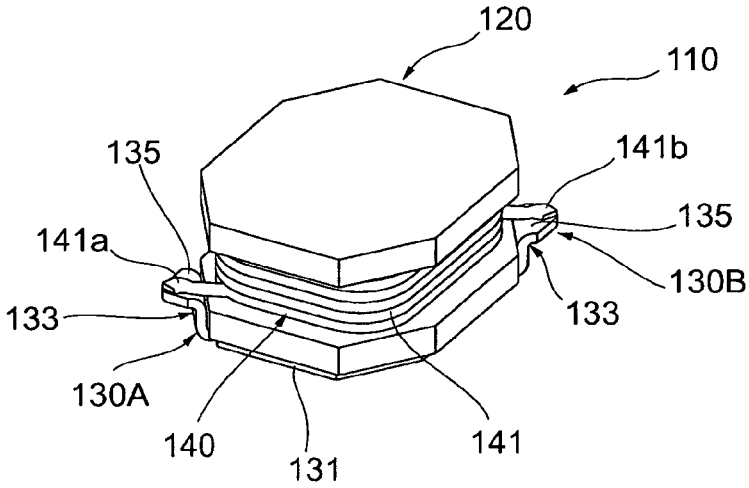
FIG. 7 Prior Art
FIG. 7 is a perspective diagram illustrating an overall configuration of a conventional magnetic component.

FIGS. 5A to 5C and 6A to 6C illustrate terminals 30C to 30H, which each have a configuration different from that of the terminals 30A and 3013 of the above-described embodiment. FIGS. 5A to 5C illustrate shapes as viewed from a side of the terminals 30C to 30E, and FIGS. 6A to 6C illustrate cross-sectional shapes of the respective wire splicing portions 33 of the terminals 30F to 30H.

In the terminal 30C illustrated in FIG. 5A, a round surface 36 is provided at a boundary part between a side surface of a wire splicing portion 33 (a side surface on a side facing the lower flange portion 25 when the terminal 30C is attached to the lower flange portion 25) and a wire splicing surface 35. In the terminal 30D illustrated in FIG. 5B, a chamfered surface 37 is provided at a boundary part between a side surface of a wire splicing portion 33 (side surface on a side facing the lower flange portion 25 when the terminal 30D is attached to the lower flange portion 25) and a wire splicing surface 35.

Where the round surface 36 or the chamfered surface 37 is provided as described above, the area of the wire splicing surface 35 is narrowed compared to that of the terminals 30A and 30B described above, but the possibility of disconnection of a conductive wire when connecting an end portion of the conductive wire to the wire splicing surface 35 via, e.g., thermal compression bonding can be decreased.

In the terminal 30E illustrated in FIG. 5C, a wire splicing surface 35 is inclined in an axial direction (height direction) of a wire splicing portion 33. In the terminal 30F illustrated in FIG. 6A, a side surface of a wire splicing portion 33 (side surface on a side facing the lower flange portion 25 when the terminal 30F is attached to the lower flange portion 25) includes a curved surface 38. Such configuration is favorable when the lower flange portion 25 has a round outer shape.

In the terminal 30G illustrated in FIG. 6B, a cross section of the wire splicing portion 33 has a rectangular shape extending over a width of an electrode portion 31. In the terminal 30H illustrated in FIG. 6C, a cross section of the wire splicing portion 33 has a square shape positioned on one side in a width direction of an electrode portion 31. Here, although the respective wire splicing portions 33 of the terminals 30G and 30H are thinner compared to those of the above-described terminals 30A and 30B, the wire splicing portions 33 are each configured so as to bear a force imposed on the wire splicing portion 33 when, e.g., thermal compression bonding is performed, by, e.g., setting the cross-sectional area of the wire splicing portions 33 (area of a cross-section perpendicular an axial direction of the wire splicing portion 33) to be larger than the cross-sectional area of the electrode portion 31 (area of a cross-section perpendicular to a longitudinal direction of the electrode portion 31).

<Other Modifications>

Although an embodiment of the present invention has been described above, the present invention is not limited to the above embodiment and various modifications are possible.

For example, although the upper flange portion 23 and the lower flange portion 25 of the magnetic core 20 each have an octagonal shape in the above embodiment, the shape of the upper flange portion 23 and the lower flange portion 25 can be varied to various shapes, e.g., a round shape or an oval shape, or another polygonal shape such as a pentagonal shape or a hexagonal shape. Also, although in the above embodiment, the upper flange portion 23 and the lower flange portion 25 are identical to each other in size and shape, flange portions that are not identical to each other and are different from each other in shape and size can be used. The shape of the winding shaft portion 21 can be changed to an arbitrary shape such as a round columnar shape or an oval columnar shape.

Although in the above embodiment, the magnetic core 20 includes a Ni—Zn ferrite or a Mn—Zn ferrite, the magnetic core 20 may be formed using another magnetic material such as a Fe—Si alloy or a Fe—Ni alloy.

Also, although in the above embodiment, thermal compression bonding and resistance welding are indicated as examples of a method for connecting an end portion of a conductive wire to a wire splicing surface of a terminal, an end portion of a conductive wire may be connected by another method such as soldering.

In the magnetic component according to the present invention, a terminal includes a columnar wire splicing portion, and an upper end surface of the wire splicing portion is configured as a wire splicing surface for conductive wire connection, enabling provision of the following operation and effects.

In other words, when connecting an end portion of a conductive wire wound around a winding shaft portion of a magnetic core to a wire splicing surface of a columnar wire splicing portion, the columnar wire splicing portion can bear a force imposed on the wire splicing surface by itself, eliminating the need to form a projection portion for supporting the wire splicing surface in a welding jig. Thus, as opposed to the conventional technique, there are no adverse effects of errors in dimension of the projection portion on the precision of connection of the conductive wire.

Also, the columnar wire splicing portion can be formed by, e.g., cutting a metal member, enabling variation of a position in the height direction of the wire splicing surface to be reduced compared to those of terminals including a wire splicing portion formed by flexing a metal plate member as in the conventional technique.

Accordingly, for example, when connecting an end portion of a conductive wire to a wire splicing surface via thermal compression bonding, a substantially-fixed distance between a lower surface of a welding electrode and the wire splicing surface can be maintained, making it easy to provide a proper extent of crushing of the end portion of the conductive wire during the thermal compression bonding, and thus, enabling the end portion of the conductive wire to be stably and favorably connected to the wire splicing surface.

Also, a method for manufacturing a magnetic component according to the present invention enables an end portion of a conductive wire wound around a winding shaft portion of a magnetic core to be stably and favorably connected to a wire splicing surface of a terminal via thermal compression bonding or resistance welding.

What is claimed is:

1. A magnetic component comprising: a magnetic core including an upper flange portion on one end side of a winding shaft portion and a lower flange portion on another end side of the winding shaft portion; a conductive terminal attached to the lower flange portion; and a conductive wire wound around the winding shaft portion, wherein the terminal includes an electrode portion extending along a lower surface of the lower flange portion and including an end portion projecting outward relative to an outer periphery of the lower flange portion, and a columnar wire splicing portion erected from the end portion of the electrode portion;

wherein an upper end surface of the wire splicing portion includes a wire splicing surface for conductive wire connection, and an end portion of the conductive wire is connected to the wire splicing surface, and wherein the terminal includes an electrode portion extending along an outer end surface of one of the flange portions and including an end portion projecting outward relative to an outer periphery of the flange portion, and a columnar wire splicing portion erected from the end portion of the electrode portion.

2. The magnetic component according to claim 1, wherein the conductive wire is a coated conductive wire including a core wire and an insulating coating covering the core wire.

3. The magnetic component according to claim 1, wherein the magnetic core is a ferrite core including an Ni—Zn ferrite or an Mn—Zn ferrite.

4. The magnetic component according to claim 1, wherein the columnar wire splicing portion erected from the end portion of the electrode portion is triangular.

5. The magnetic component according to claim 4, wherein the wire splicing surface, which is an upper end surface of the erected part of the wire splicing portion, is arranged perpendicular to a side surface of the erected part.

6. The magnetic component according to claim 4, wherein a height H of the wire splicing portion is larger than a length T-R obtained by subtracting a length R corresponding to a radius of the conductive wire wound around the winding shaft portion from a thickness T of the flange portion.

7. The magnetic component according to claim 6, wherein the height H of the wire splicing portion is smaller than a length T+W-D obtained by subtracting a length D corresponding to a diameter of the conductive wire wound around the winding shaft portion from a value obtained by adding a width W of the winding shaft portion to the thickness T.

8. The magnetic component according to claim 6, wherein the height H of the wire splicing portion is smaller than a length T+D obtained by adding a length D corresponding to a diameter of the conductive wire wound around the winding shaft portion to the thickness T.

9. The magnetic component according to claim 1, wherein the conductive wire has a diameter of 0.02 to 0.30 mm.

10. The magnetic component according to claim 1, wherein the conductive wire has a diameter of 0.02 to 0.10 mm.

11. The magnetic component according to claim 1, wherein a round surface is provided in a boundary part between a side surface of the wire splicing portion and the wire splicing surface.

12. The magnetic component according to claim 1, wherein a boundary part between a side surface of the wire splicing portion and the wire splicing surface is a chamfered surface.

13. The magnetic component according to claim 1, wherein a side surface of the wire splicing portion of the terminal includes a curved surface.

14. A magnetic component manufacturing method comprising connecting the end portion of the conductive wire of the magnetic component according to claim 1 to the wire splicing surface via thermal compression bonding or resistance welding.

* * * * *